US010844525B2

(12) United States Patent
Ohanians

(10) Patent No.: US 10,844,525 B2
(45) Date of Patent: Nov. 24, 2020

(54) THERMAL INSULATING FABRIC

(71) Applicant: Raffi Ohanians, Woodland Hills, CA (US)

(72) Inventor: Raffi Ohanians, Woodland Hills, CA (US)

( * ) Notice: Subject to any disclaimer, the term of this patent is extended or adjusted under 35 U.S.C. 154(b) by 0 days.

(21) Appl. No.: 16/823,986

(22) Filed: Mar. 19, 2020

(65) Prior Publication Data

US 2020/0299872 A1 Sep. 24, 2020

Related U.S. Application Data

(60) Provisional application No. 62/821,369, filed on Mar. 20, 2019.

(51) Int. Cl.

| | |
|---|---|
| ***D03D 15/00*** | (2006.01) |
| ***D03D 1/00*** | (2006.01) |
| ***A41D 1/06*** | (2006.01) |
| ***D03D 17/00*** | (2006.01) |

(52) U.S. Cl.

CPC ..... *D03D 15/00* (2013.01); *A41D 1/06* (2013.01); *D03D 1/00* (2013.01); *D03D 17/00* (2013.01); *A41D 2500/20* (2013.01); *D03D 2700/0137* (2013.01); *D10B 2201/02* (2013.01); *D10B 2211/02* (2013.01); *D10B 2401/061* (2013.01); *D10B 2501/04* (2013.01)

(58) Field of Classification Search

CPC . A41D 31/00; A41D 1/00; A41D 1/06; A41D 2500/20; D03D 1/00; D03D 15/00; D03D 2700/0133; D03D 2700/0137; D03D 17/00; D10B 2211/02; D10B 2201/02; D10B 2401/061; D10B 2501/04

See application file for complete search history.

(56) References Cited

U.S. PATENT DOCUMENTS

| | | | | |
|---|---|---|---|---|
| 6,389,851 | B1 * | 5/2002 | Groshens ..... | D04B 21/14 66/192 |
| 9,745,674 | B2 | 8/2017 | Hines et al. | |
| 10,030,326 | B2 | 7/2018 | Hines, Jr. et al. | |

(Continued)

FOREIGN PATENT DOCUMENTS

| | | | |
|---|---|---|---|
| CN | 102268764 | A | 12/2011 |
| CN | 205974881 | U | 2/2017 |

(Continued)

*Primary Examiner* — Robert H Muromoto, Jr.

(74) *Attorney, Agent, or Firm* — Hackler Daghighian Martin & Novak

(57) ABSTRACT

A fabric for a pair of jeans is disclosed. The fabric has a plurality of warp threads and a plurality of weft threads. The plurality of warp threads include a jeans warp thread, such as cotton, disposed next to an insulating warp thread, such as wool, in a repeating series. The plurality of weft threads include a plurality of jeans weft threads disposed next to one another in a repeating series. The plurality of warp threads and weft threads are perpendicularly interwoven in a twill weave defining a front side opposite a back side. From the front side of the fabric, each jeans warp thread is woven over three jeans weft threads and under one jeans weft thread in a repeating series. From the front side of the fabric, each insulating warp thread is woven under three jeans weft threads and over one jeans weft thread in a repeating series.

13 Claims, 7 Drawing Sheets

(56) References Cited

U.S. PATENT DOCUMENTS

| | | | | |
|---|---|---|---|---|
| 2002/0124366 | A1 | 9/2002 | Hirsch | |
| 2006/0228538 | A1 | 10/2006 | Carrhassett | |
| 2007/0141940 | A1 | 6/2007 | Baychar | |
| 2009/0038706 | A1 | 2/2009 | Pereira | |
| 2010/0075557 | A1 | 3/2010 | Shteiyer | |
| 2011/0171467 | A1* | 7/2011 | Cavalier, II | D03D 15/12 428/365 |
| 2011/0308022 | A1 | 12/2011 | Li et al. | |
| 2013/0152277 | A1* | 6/2013 | Rakitin | D06B 1/00 2/243.1 |
| 2013/0216810 | A1 | 8/2013 | Hines et al. | |
| 2014/0223633 | A1* | 8/2014 | Baba | A41D 1/06 2/69 |
| 2015/0191856 | A1 | 7/2015 | Hines et al. | |
| 2015/0292147 | A1* | 10/2015 | Mukhopadhyay | D06M 16/003 435/209 |
| 2016/0083877 | A1 | 3/2016 | Kalfa Kilickan et al. | |
| 2016/0108577 | A1 | 4/2016 | Gulati | |
| 2016/0120249 | A1 | 5/2016 | Baychar | |
| 2016/0237598 | A1 | 8/2016 | Henssen | |
| 2017/0086522 | A1* | 3/2017 | Goenka | A41D 23/00 |
| 2017/0198423 | A1 | 7/2017 | Hines, Jr. et al. | |

FOREIGN PATENT DOCUMENTS

| | | | | |
|---|---|---|---|---|
| CN | 207875018 | U | | 9/2018 |
| EP | 3 231 907 | A1 | | 10/2017 |
| JP | 05287637 | A | * | 11/1993 |
| WO | 2018/158391 | A1 | | 9/2018 |
| WO | 2018/227232 | A1 | | 12/2018 |

* cited by examiner

THERMAL INSULATING FABRIC

CROSS-REFERENCE TO RELATED APPLICATIONS

This non-provisional application claims priority to the provisional application 62/821,369 filed on Mar. 20, 2019, the entire contents of which are hereby incorporated in full by this reference.

DESCRIPTION

Field of the Invention

The present invention generally relates to a fabric that has increased thermal insulation, stretch properties, and moisture control due to its novel blend as taught herein.

Background of the Invention

Various types of jeans apparel are known in the prior arts, typically made from denim or dungaree cloth, which is a rugged, sturdy, and twill weave woven from 100% cotton fabric. The jeans apparel is a very desirable fashion clothing since it is comfortable, affordable for every age, and very practical for the work environment. However, none of the prior art teachings that have been disclosed provide or suggest the advantage of utilizing a wool insulation technique of the present invention, to thereby provide a benefit for cold weather and related harsh environments while preserving the denim jeans characteristics and looks. In addition, none of the prior art teachings that have been disclosed in recent years include a special insulating yarn (wool or other) construction weaved with jeans' cotton as taught by the present invention. Furthermore, none of the prior art teachings that have been disclosed can provide insulation while adding stretching capacity without using elastic material. In addition, none of the prior art teachings that have been disclosed provide a moisture barrier, a breathable, a more durable and a recyclable jeans. A warmer jeans as taught herein can extend all its desirable and valuable benefits into cold seasons and environments resulting in a happier and healthier life, and even can lower the elevated cold life mortalities. The present invention fulfills these needs and provides other related advantages.

SUMMARY OF THE INVENTION

The fabric of the present invention can be used to make a pair of jeans which are normally made from cotton, denim or dungaree cloth, and are often commonly referred to as blue jeans due to the typical bluish color. However, other colors are also known in the art. More particularly, in order to keep the body warm, while preserving the original jeans' look, the present invention relates to a jeans (denim) garment with a modified hidden warp layer or modified weft fiber. The modified layer/fiber can be wool fiber from sheep, such as merino wool, cashmere or mohair from goat, qiviut from muskoxen, hide or fur clothing from bison, angora from rabbits, or other types of wool from camelids, alpaca, vicuna, or other breeds of cattle and swine. The modified layer/fiber can also be a fiber that has wool characteristics, skin friendly, and traps heat, such as special synthetic or organic material, herein referred to as wool.

The present invention uses wool because of its natural, excellent, and effective thermal insulator characteristics. Because of springiness of wool and because of the unique interwoven construction of the modified fabric, in addition to insulation, the modified layer/fiber adds a stretching feature to the present invention jeans apparel. The present invention, due to excellent characteristics of wool, makes the jeans an excellent water repellent and moisture absorbent by allowing it to perspire from the body to evaporate and makes skin to feel dry. The present invention uses wool to make the jeans apparel a desirable winter clothing, due to wrinkle resistance and durability versus cotton and its renewable and recyclable characteristics. While this teaching of the present invention is generally applied to the material of jeans for thermal insulation, the same weaving insulation technique can also be applied to other fabrics.

"Warp" and "weft" are the two basic components used in weaving to turn thread or yarn into fabric. The lengthwise or longitudinal warp yarns are held stationary in tension on a frame or loom while the transverse weft yarn is drawn through and inserted over-and-under the warp yarns. A single thread of the weft crossing the warp is called a pick. Terms may vary by those skilled in the art, for instance in North America the weft is sometimes referred to as the fill or the filling yarn. Each individual warp thread in a fabric is called a warp end or end.

One exemplary embodiment of the present invention is best shown in FIGS. 3-4, where a fabric (20) for a pair of jeans consists of (or comprises): a plurality of warp threads; a plurality of weft threads; wherein the plurality of warp threads comprise a jeans warp thread (21) disposed next to an insulating warp thread (23) in a repeating series; wherein the plurality of weft threads comprise a plurality of jeans weft threads (22) disposed next to one another in a repeating series; wherein the plurality of warp threads and weft threads are perpendicularly interwoven in a twill weave defining a front side opposite a back side; wherein, from the front side of the fabric, each jeans warp thread is woven over three jeans weft threads and under one jeans weft thread in a repeating series; and wherein, from the front side of the fabric, each insulating warp thread is woven under three jeans weft threads and over one jeans weft thread in a repeating series such that a diagonal pattern is created apparent from both the front side and the back side.

The jeans weft thread may be cotton and the insulating warp thread may be wool.

In other exemplary embodiments, the insulating warp thread may be merino wool, synthetic wool, cashmere, giviut, angora, mohair, denim or dungaree cloth.

The fabric may have an increase of at least 4 percent stretch in both the warp and weft directions in comparison to an all-cotton twill weave fabric.

Another exemplary embodiment of the present invention is best shown in FIGS. 5-6, where a fabric (20) for a pair of jeans consists of (or comprises): a plurality of warp threads; a plurality of weft threads; wherein the plurality of warp threads comprise a plurality of jeans warp threads (21) disposed next to one another in a repeating series; wherein the plurality of weft threads comprise a plurality of insulating weft threads (24) disposed next to one another in a repeating series; wherein the plurality of warp threads and weft threads are perpendicularly interwoven in a twill weave defining a front side opposite a back side; wherein, from the front side of the fabric, each jeans warp thread is woven over three insulating weft threads and under one insulating weft thread in a repeating series.

The jeans warp thread may be cotton and the insulating weft thread may be wool.

The fabric may have an increase of at least 8 percent stretch in the weft direction in comparison to an all-cotton twill weave fabric.

Another exemplary embodiment of the present invention is best shown in FIG. 7, where a fabric (20) for a pair of jeans consists of (or comprises): a plurality of warp threads; a plurality of weft threads; wherein the plurality of warp threads comprise a plurality of jeans warp threads (21) disposed next to one another in a repeating series; wherein the plurality of weft threads comprise a plurality of insulating weft threads (24) disposed next to one another in a repeating series; wherein the plurality of warp threads and weft threads are perpendicularly interwoven in a twill weave defining a front side opposite a back side; wherein, from the front side of the fabric, each jeans warp thread is woven over two insulating weft threads and under one insulating weft thread in a repeating series.

The jeans warp thread may be cotton and the insulating weft thread may be wool.

The fabric may have an increase of at least 8 percent stretch in the weft direction in comparison to an all-cotton twill weave fabric.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Jeans, including denim, is traditionally a strong fabric made from 100% cotton. Denim fabric has a twill fabric weave. Fibers are weaved on a loom in a twill weave pattern in different twill constructions. That is, passing the weft thread over one or more warp threads and then under one or more warp threads and so on, with a "step," or offset, between rows to create the characteristic diagonal pattern.

Figure 1:
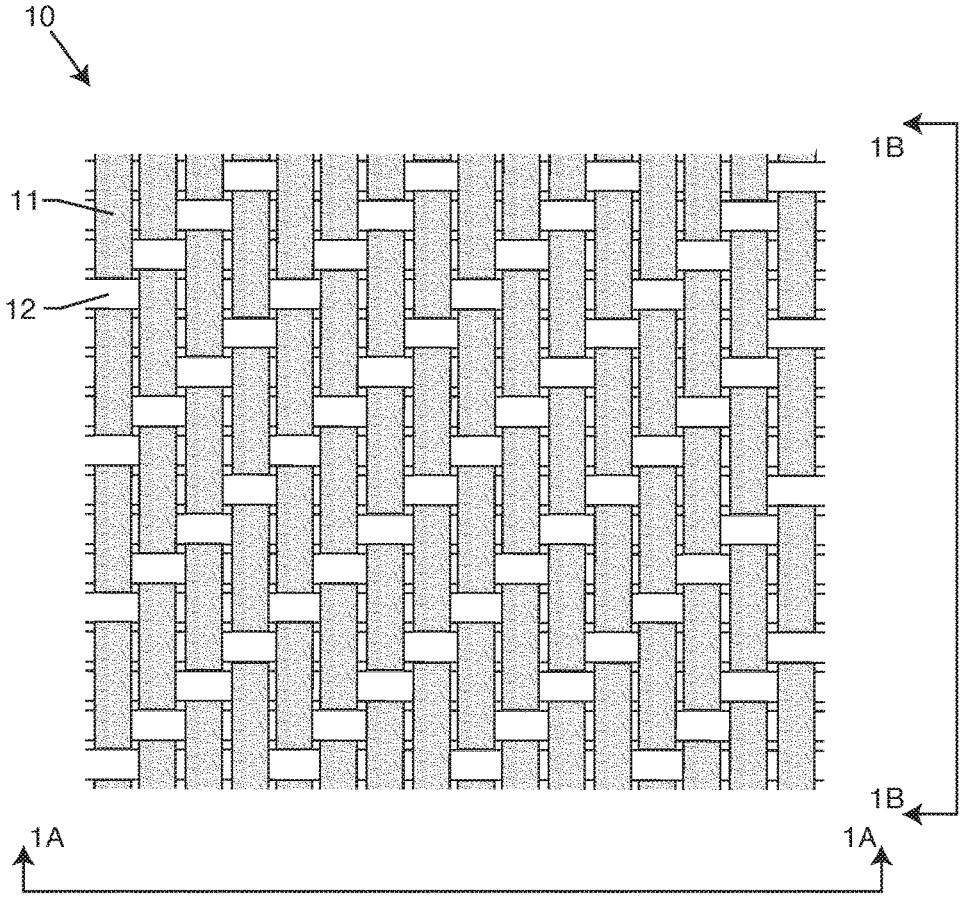
FIG. 1 PRIOR ART
FIG. 1 illustrates a weave pattern of the front side of a loom for a traditional 3/1 cotton twill blue jeans construction having a diagonal weft.
Figure 1B:
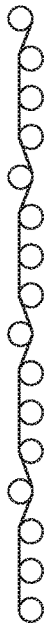
FIG. 1B is a sectional view taken along lines 1B-1B from FIG. 1.
Figure 1A:
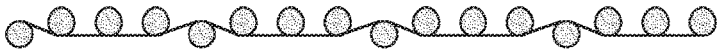
FIG. 1A is a sectional view taken along lines 1A-1A from FIG. 1.

FIG. 1 shows a traditional 3×1 twill jeans front construction 10. Usually, blue jeans denim is made from tightly woven fabric blue cotton warp yarns 11 and white cotton filling yarns 12. The filling yarns are placed across the width of the fabric and interlaced at a 90-degree angle with warp yarns. The interwoven pattern of diagonal lines from this process is called the "twill weave". Twill is a versatile fabric weave encountered every day. It is notably used for couches and denim jeans. The twill weave is characterized by its diagonal lines, which are created by an offset in the warp threads. Twill is popular because it is very durable and hides stains well, and it is used for jeans, chinos, furniture coverings, bags, and more.

Twill is one of the three major types of textile weaves, along with satin and plain weaves. The distinguishing characteristic of the twill weave is a diagonal rib pattern. Twill weaves have a distinct, often darker colored front side (called the wale) with a lighter back. Twill has high thread count, which means that the fabric is opaque, thick, and durable. Twill fabrics are rarely printed on, though multiple colored yarns can be used to achieve designs like tweed and houndstooth.

In weaving twill, the weft thread (the horizontal thread) is woven over one or more warp threads (the vertical thread held taught on a loom) and then under one or more warp threads. Each row is offset from the one above, which creates the diagonal pattern. Twill weaves are categorized into fractions to denote how they were woven. For example, a twill labeled as 3/1 means that the weft is woven over three warp threads and under one warp thread.

Figure 2:
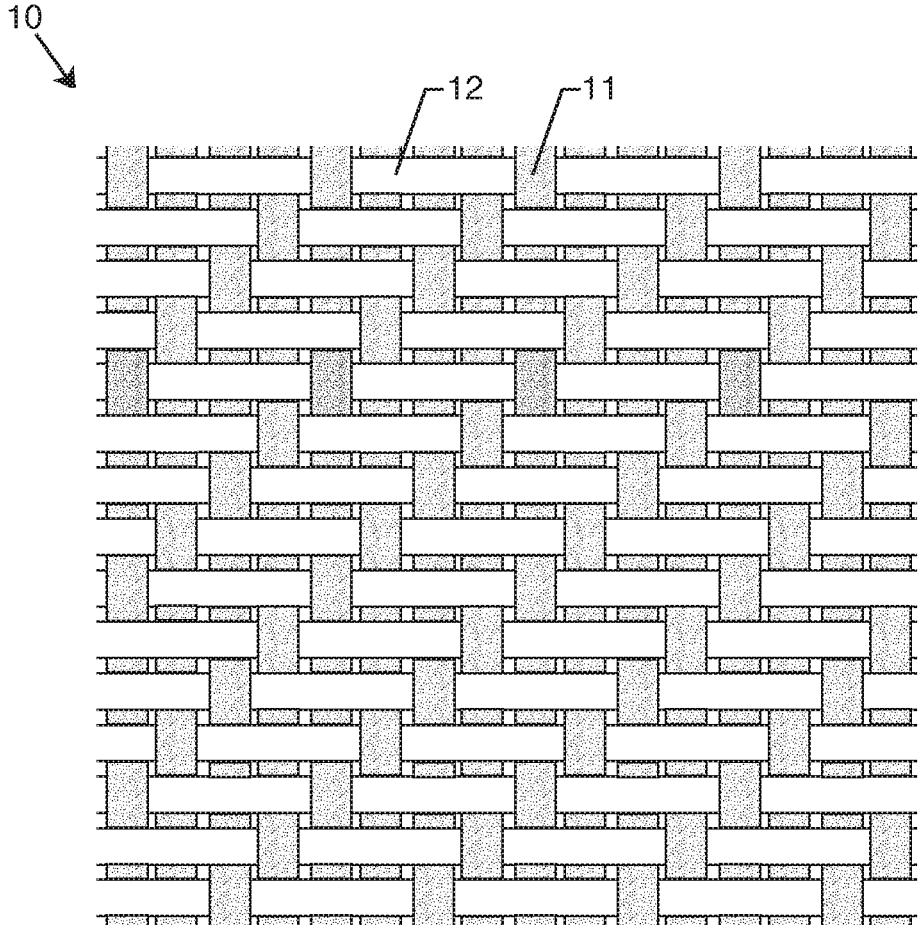
FIG. 2 PRIOR ART
FIG. 2 illustrates the back side of the loom of the weave pattern of FIG. 1.

FIG. 2 shows the back side of FIG. 1 of the standard 3/1 twill weave jeans pattern with diagonal weft yarns.

Figure 3:
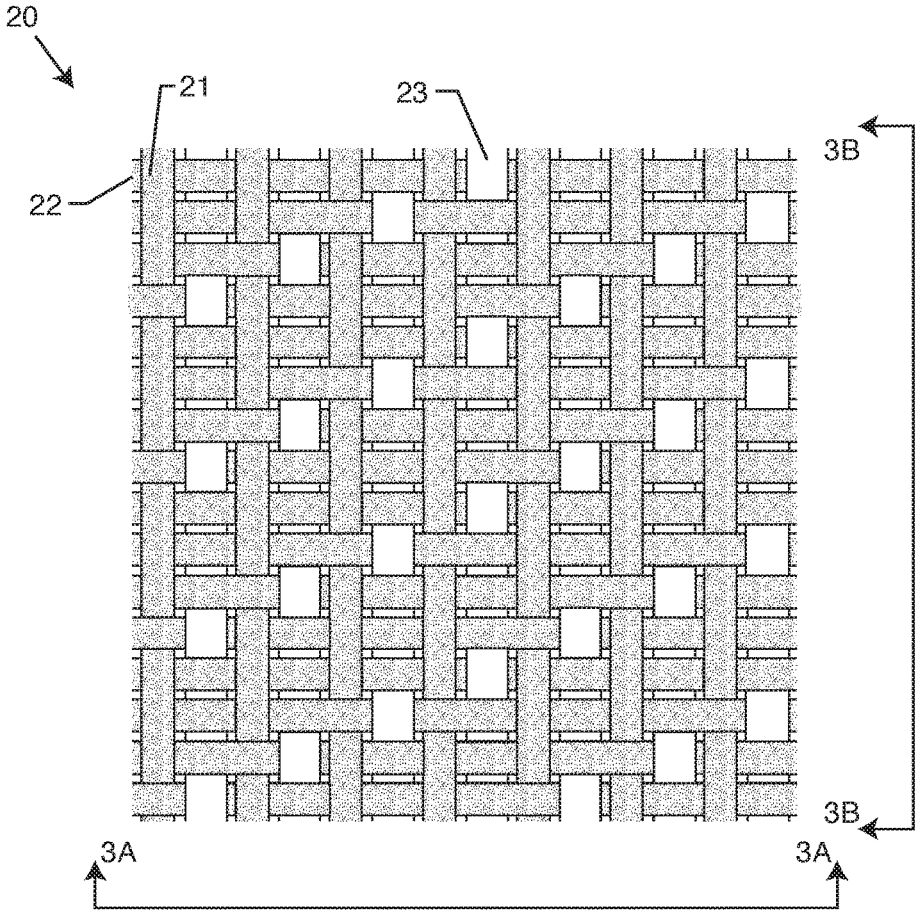
FIG. 3 illustrates one embodiment of a weave pattern of the present invention for a 3/1 twill, warp wool insulation construction, showing the front side of loom with a diagonal warp wool.

FIG. 3 shows one embodiment of the present invention warp wool insulation construction 20 of a 3/1 twill pattern. This embodiment 20 uses a cotton warp 21, such as denim blue thread, over three cotton weft threads 22. Additionally an insulating (white) wool warp thread 23 is added in between cotton warp threads such that the insulating thread this time passes under the three cotton weft threads, then over one or more weft threads and so on. When the fabric is pushed to fill tightly, the insulating wool threads add a half layer of thermal shield that is hidden under the fabric which prevents cold from penetrating the fabric and reaching skin.

Figure 3B:
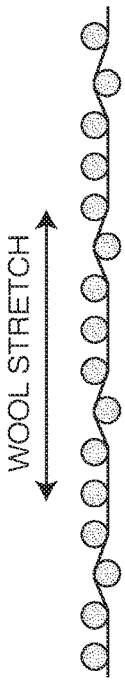
FIG. 3B is a sectional view taken along lines 3B-3B from FIG. 3.
Figure 3A:
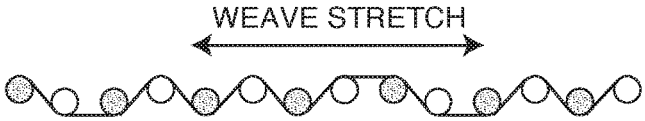
FIG. 3A is a sectional view taken along lines 3A-3A from FIG. 3.

As best shown in FIGS. 3A and 3B, this novel fabric becomes stretchable in the warp direction because of wool, and is stretchable in the weft direction because of its special mesh woven construction. The cross sections of the present invention fabric show how the stretching interwoven feature is formed in the weft direction, as shown by increased woven pattern of the yarns. This special construction creates a diagonal wool warp pattern, as shown in FIG. 3.

Figure 4:
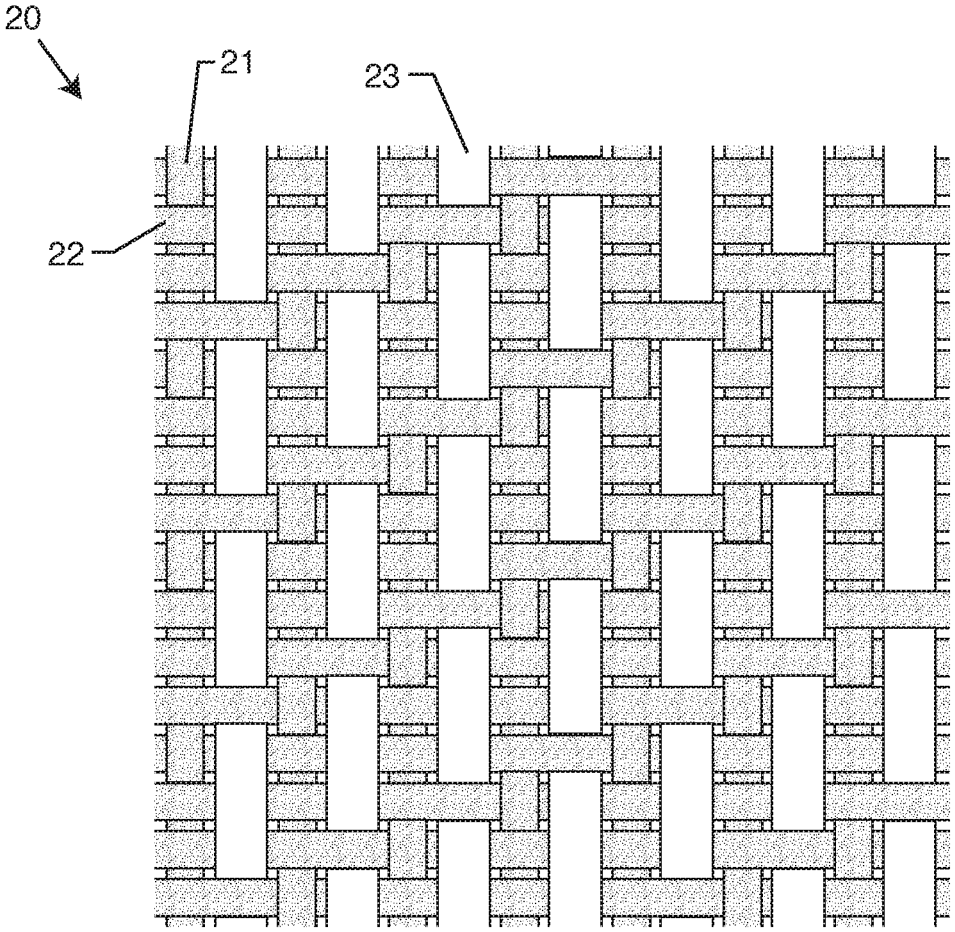
FIG. 4 illustrates the back side of the loom of the weave pattern of FIG. 3.

FIG. 4 shows the back side (of the loom) of the warp wool insulation invention construction and the wool layer of FIG. 3.

Figure 5:
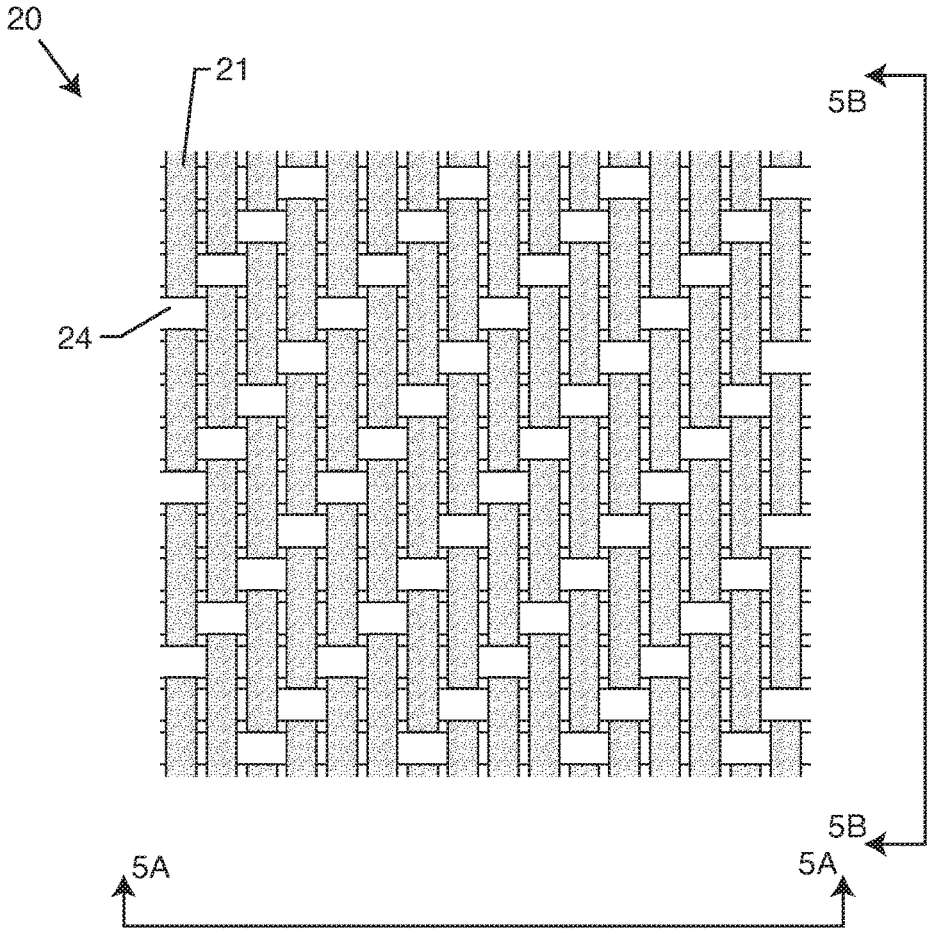
FIG. 5 illustrates another embodiment of a weave pattern of the present invention for a 3/1 twill, warp wool insulation construction, showing the front side of the loom.
Figure 5B:
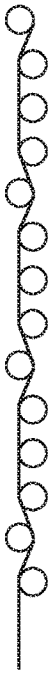
FIG. 5B is a sectional view taken along lines 5B-5B from FIG. 5.
Figure 5A:
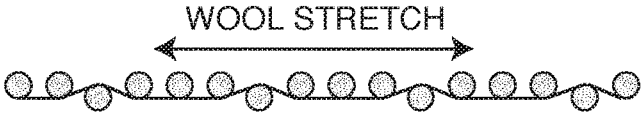
FIG. 5A is a sectional view taken along lines 5A-5A from FIG. 5.
Figure 6:
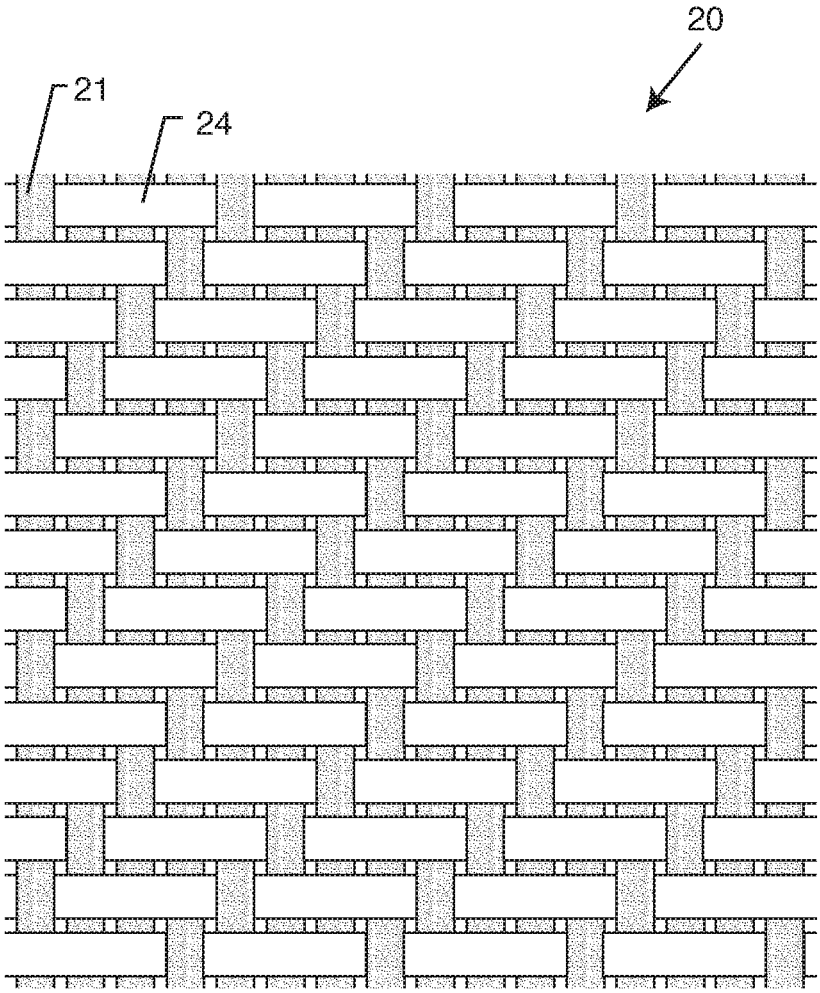
FIG. 6 illustrate the back side of the loom of the weave pattern of FIG. 5.

Stretch jeans are a style of jeans made of stretch denim fabric. Stretch denim is a relatively new type of denim cotton/polyester blend that incorporates elastane, a stretchy, synthetic fiber, also known as Spandex®, or Lycra®, into the fabric. To achieve higher elasticity plus good insulation, another embodiment of the present invention shown in FIG. 5 uses a full wool weft layer 24 in the twill weave pattern and a full cotton warp 21. This unique embodiment of the full wool insulation invention construction adds a full layer of thermal insulating wool threads shield under the fabric, that fully prevents cold from penetrating the fabric to reach skin. In contrast to a standard cotton layer which blends elastic material in the cotton to provide stretch, the present invention wool warp construction makes the fabric stretchable in the weft direction. FIG. 5 shows the front side of the loom while FIG. 6 shows the back side of the structure of FIG. 5.

As can be understood by those skilled in the art, the insulating yarn/thread can be a made of wool or other fibers, exclusively fabricated to act as a good heat insulator, while matching with the cotton warp fiber stretch, shrinkage, tension characteristics, durability, color composition, and desirable physical appearance. As can be understood by those skilled in the art, the insulating techniques stated above can also be applied in different twill weaving blends.

Figure 7:
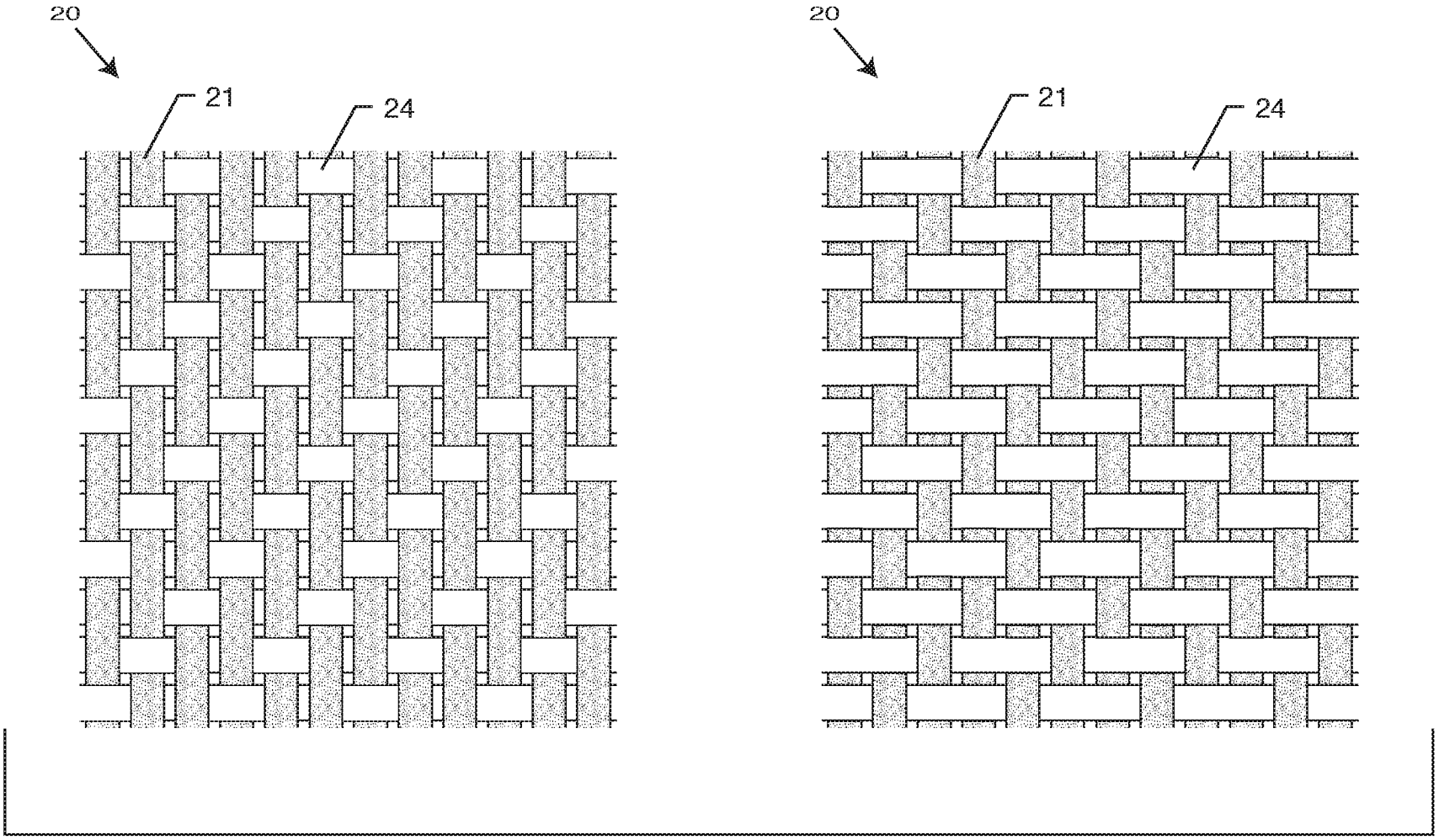
FIG. 7 illustrates another embodiment of a weave pattern of the present invention for a 2/1 twill, warp wool insulation construction, showing the front side (left) and back side (right) of the loom.

FIG. 7 is another embodiment of the present invention for a full wool insulation construction for a 2×1 twill with insulating wool weft fibers. The front side of the loom is shown on the left whereas the back side of the loom is shown on the right. The same techniques and teachings as taught herein are applicable to this embodiment and therefore are not repeated herein.

The present invention has recognized the insulating deficiencies in the jeans apparel (or other fabrics) known with the prior fabrics and has constructed a new jeans apparel that can overcome those deficiencies. More specifically, the present invention discloses a layer of insulation, such as wool or other fibers, used in the jeans fabric, to act as thermal insulation, and to block transfer of cold air through the jeans fabric to reach the skin. Another advantage of the present invention is that, while it adds thermal insulation, it preserves the physical look of the jeans (or other fabrics) and retains the original shape, style, and ruggedness that is desirable. Another advantage of the present invention is that, it gives the fabric stretching capability in lieu of elastic material such as spandex and polyester. Based on preliminary test performed, the warp wool insulation construction embodiment adds approximately 4% stretch capacity in both directions and the full wool insulation construction embodiment adds approximately 8% increase in stretching capacity in the wool direction. An additional advantage of the present invention is that, because of it use of wool material, the jeans inherits other advantages of wool such as water repellent and moisture absorbent, wrinkle resistance and more durable, adds renewable and recyclable characteristics, and makes the jeans apparel a desirable winter clothing. The advantage of the present invention is that it enables current and new variations of the jeans twill fabric weaves to be manufactured with added insulation layer without distressing the legacy jeans fabric. Examples of the current prior art jeans variations include 100% cotton denim, colored denim, stretch denim, selvedge denim, acid wash denim, bull denim, etc.

The present invention is not related to weaving patterns and its classifications. The invention is not related to blending fabrics either. The disclosure is related to special fabric construction that provides unique benefit to jeans fabric without disturbing the original looks and usage. In fact, the disclosure is constructed to retain the jeans look and provide minimum impact on the originality of a jeans fabric. The disclosure can be applied to all denim including 3×1 Right Hand Twill (RHT) by Levi's®, 3×1 Left Hand Twill (LHT) by Lee®, and Broken Twill (BT) by Wrangler®.

Although several embodiments have been described in detail for purposes of illustration, various modifications may be made to each without departing from the scope and spirit of the invention. Accordingly, the invention is not to be limited, except as by the appended claims.

What is claimed is:

1. A fabric for a pair of jeans, the fabric consisting of:
a plurality of warp threads; and
a plurality of weft threads;
wherein the plurality of warp threads and weft threads are perpendicularly interwoven in a twill weave defining a front side opposite a back side;
wherein the plurality of warp threads comprise a jeans warp thread disposed next to an insulating warp thread in a repeating series;
wherein the plurality of weft threads comprise a plurality of jeans weft threads disposed next to one another in a repeating series;
wherein, from the front side of the fabric, each jeans warp thread is woven over three jeans weft threads and under one jeans weft thread in a repeating series; and
wherein, from the front side of the fabric, each insulating warp thread is woven under three jeans weft threads and over one jeans weft thread in a repeating series.

2. The fabric of claim 1, wherein the jeans warp and weft thread is cotton.

3. The fabric of claim 2, wherein the insulating warp thread is wool.

4. The fabric of claim 2, wherein the insulating warp thread is merino wool.

5. The fabric of claim 2, wherein the insulating warp thread is synthetic wool.

6. The fabric of claim 2, wherein the insulating warp thread is cashmere.

7. The fabric of claim 2, wherein the insulating warp thread is qiviut.

8. The fabric of claim 2, wherein the insulating warp thread is angora.

9. The fabric of claim 2, wherein the insulating warp thread is mohair.

10. The fabric of claim 3, wherein the fabric comprises an increase of at least 4 percent stretch in both the warp and weft directions in comparison to an all-cotton twill weave fabric, the all-cotton twill weave fabric utilizing the same cotton as the fabric.

11. The fabric of claim 1, wherein the twill weave creates a diagonal pattern viewed from the front side and the back side.

12. A fabric for a pair of jeans, the fabric consisting of:
a plurality of warp threads; and
a plurality of weft threads;
wherein the plurality of warp threads and weft threads are perpendicularly interwoven in a twill weave defining a front side opposite a back side, wherein the twill weave creates a diagonal pattern viewed from the front side and the back side;
wherein the plurality of warp threads comprise a cotton warp thread disposed next to a wool warp thread in a repeating series;
wherein the plurality of weft threads comprise a plurality of cotton weft threads disposed next to one another in a repeating series;
wherein, from the front side of the fabric, each cotton warp thread is woven over three cotton weft threads and under one cotton weft thread in a repeating series; and
wherein, from the front side of the fabric, each wool warp thread is woven under three cotton weft threads and over one cotton weft thread in a repeating series.

13. A fabric for a pair of jeans, the fabric comprising:

a plurality of warp threads; and a plurality of weft threads;

wherein the plurality of warp threads and weft threads are perpendicularly interwoven in a twill weave defining a front side opposite a back side, wherein the twill weave creates a diagonal pattern viewed from the front side and the back side;

wherein the plurality of warp threads comprise a cotton warp thread disposed next to a wool warp thread in a repeating series;

wherein the plurality of weft threads comprise a plurality of cotton weft threads disposed next to one another in a repeating series;

wherein, from the front side of the fabric, each cotton warp thread is woven over three cotton weft threads and under one cotton weft thread in a repeating series; and wherein, from the front side of the fabric, each wool warp thread is woven under three cotton weft threads and over one cotton weft thread in a repeating series.

* * * * *